United States Patent [19]

Nielsen

[11] 3,942,944

[45] Mar. 9, 1976

[54] HEATING OF AGGREGATE MATERIAL FOR ASPHALT MIXING

[75] Inventor: Aage Nielsen, Copenhagen, Denmark

[73] Assignee: H. Nielsen & Son Maskinfabrik A/S, Herlev, Denmark

[22] Filed: Mar. 13, 1974

[21] Appl. No.: 450,919

[30] Foreign Application Priority Data

Mar. 16, 1973 Denmark ..... 1462/73

[52] U.S. Cl. ..... 432/132; 432/17; 432/164

[51] Int. Cl.[2] ..... F27B 9/02

[58] Field of Search ..... 432/11, 12, 17, 129, 130, 432/132, 144, 164; 34/31

[56] References Cited

UNITED STATES PATENTS

| | | | |
|---|---|---|---|
| 804,379 | 11/1905 | Chase | 432/130 |
| 823,393 | 6/1906 | Chase | 432/130 |
| 2,251,150 | 7/1941 | Merkel | 432/130 |
| 3,259,995 | 7/1966 | Powischill | 34/31 |
| 3,659,829 | 5/1972 | Pospisil et al. | 432/17 |
| 3,746,537 | 7/1973 | Haibach | 432/17 |

*Primary Examiner*—John J. Camby
*Attorney, Agent, or Firm*—Browne, Beveridge, DeGrandi & Kline

[57] ABSTRACT

A method and an apparatus for heating a granular aggregate for mixture with asphalt by means of a flue gas being chemically inert to the aggregate. The aggregate is moved intermittently within the gas under control of the stationary periods of driven screw conveyors. The apparatus has several heating sections, each section having a conveyor, a thermostat with a sensing device at the end of the section, and possibly also an oil burner, the thermostat being connected to the driving means of the conveyor.

6 Claims, 4 Drawing Figures

Figure 1:
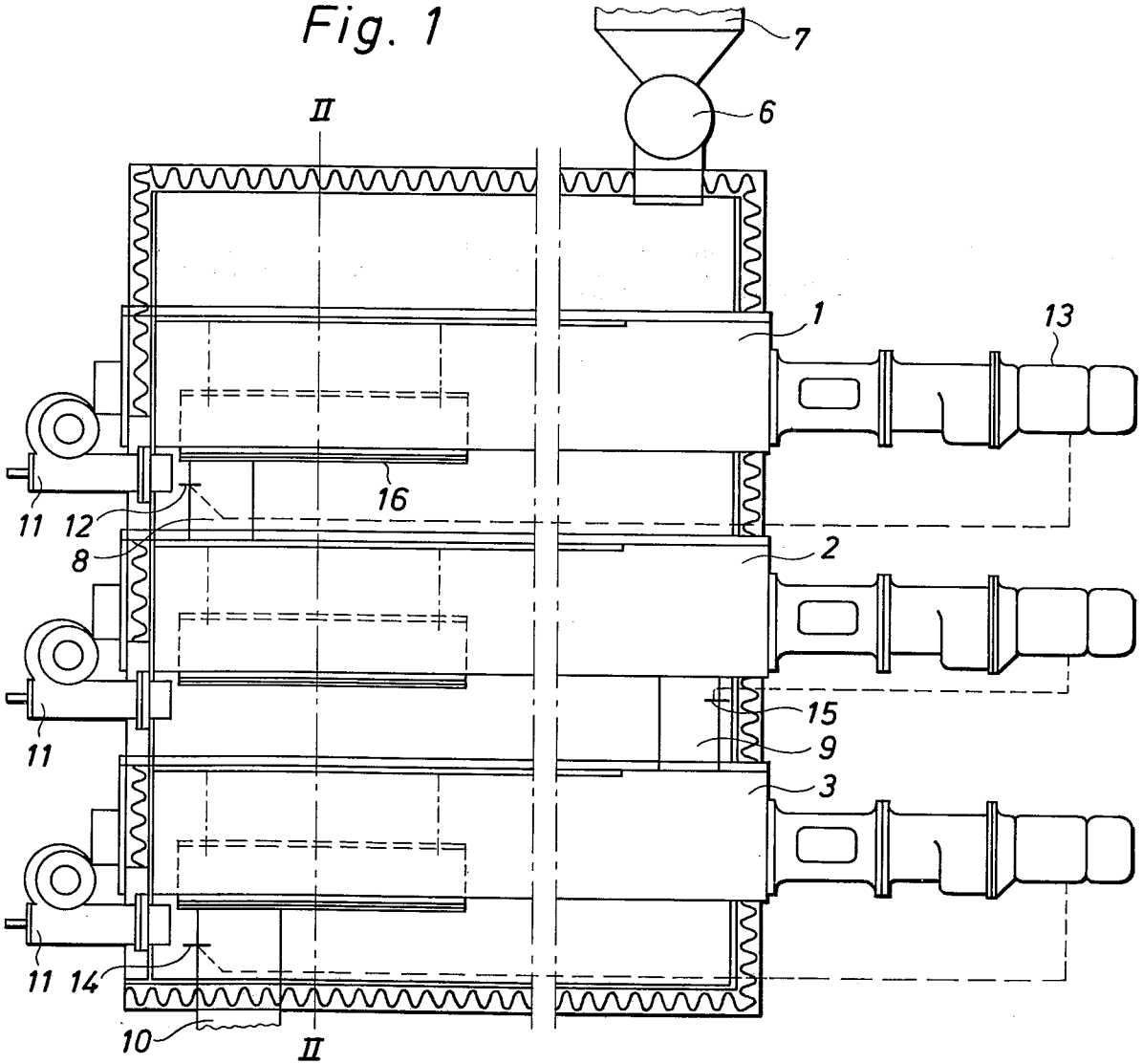

7
6
13
1
2
15
9
3
16
II
II
10
12
8
14
11
11
11

5
4
16
11
11
11
8

HEATING OF AGGREGATE MATERIAL FOR ASPHALT MIXING

The invention relates to a method for heating a granular aggregate, such as limestone powder, possibly mixed with bonding agents and/or natural asphalt by means of flue gas being chemically inert to the aggregate.

Such aggregate in form of anhydrous limestone powder has previously been added to the hot asphalt in cold condition. It is also known to add heated limestone powder to the asphalt. It has appeared to be of importance that the aggregate and the asphalt during mixing have substantially the same temperature whereby the mixing is quicker and a more homogeneous product is obtained.

The object of the invention is to provide a method permitting of a very precise control of the temperature of the aggregate, this object being achieved thereby that the granular aggregate, while the flue gas is continuously passing it, is moved intermittently according to a desired heating sequence of the aggregate (a desired shape of the heating curve of the aggregate).

The method according to the invention may have the essential feature that each section of the apparatus used for this method is controlled in such a manner that in its material discharge channel a desired temperature is constantly maintained by controlling the duration of the stationary periods of an intermittently driven conveyor. As a result the desired temperatures at certain points of the heating curve are obtained in a very simple manner.

A method according to the invention may furthermore have the peculiar feature that after having obtained a uniform material temperature all through the apparatus an infinitely variable control between 10 and 100% of the capacity may be provided while maintaining a correct thermal balance of each section. As a result the apparatus may easily be adjusted exactly to the capacity required in each case.

According to the invention the control is made proportionally and simultaneously in three sections of the apparatus. As a result it is ensured that the desired heating sequence of the aggregate is in fact being obtained.

The invention also relates to an apparatus for carrying out the method, said apparatus having one or more flue gas producing units. A peculiar feature of this apparatus is that it has a plurality of heating sections, each of which having a conveyor and possibly also a flue gas unit, each section having a thermostat with a sensing device for sensing the temperature of the aggregate and for controlling the duration of the stationary periods of the conveyor while intermittently moving the conveyor of each section. As a result the method according to the invention may be carried out in a very simple manner.

According to the invention each conveyor may consist of a screw thus ensuring a reliable conveying of the aggregate in each section.

Further according to the invention each conveyor may advantageously consist of a scraping conveyor.

Besides the invention makes it possible that each flue gas unit may consist of one or more oil burners, thus providing for a very easy adjustment of the flue gas temperature and the flue gas flow to each section.

Moreover the invention permits that all sections are arranged on top of each other and that all flue gas units are arranged below the lowermost section permitting the flue gases to flow upwardly from one section to the other. As a result a good economy is achieved, since some of the flue gases will give off heat for a relatively long period of time.

Finally according to the invention the partitions between the sections arranged on top of each other may be formed in such a way that the flue gases in one section are conducted around the conveyor for heating the transport means and the material thereof before the flue gases are permitted to flow upwardly into the above section. The result obtained is a further improvement of the giving off of heat from the flue gases.

Figure 3:
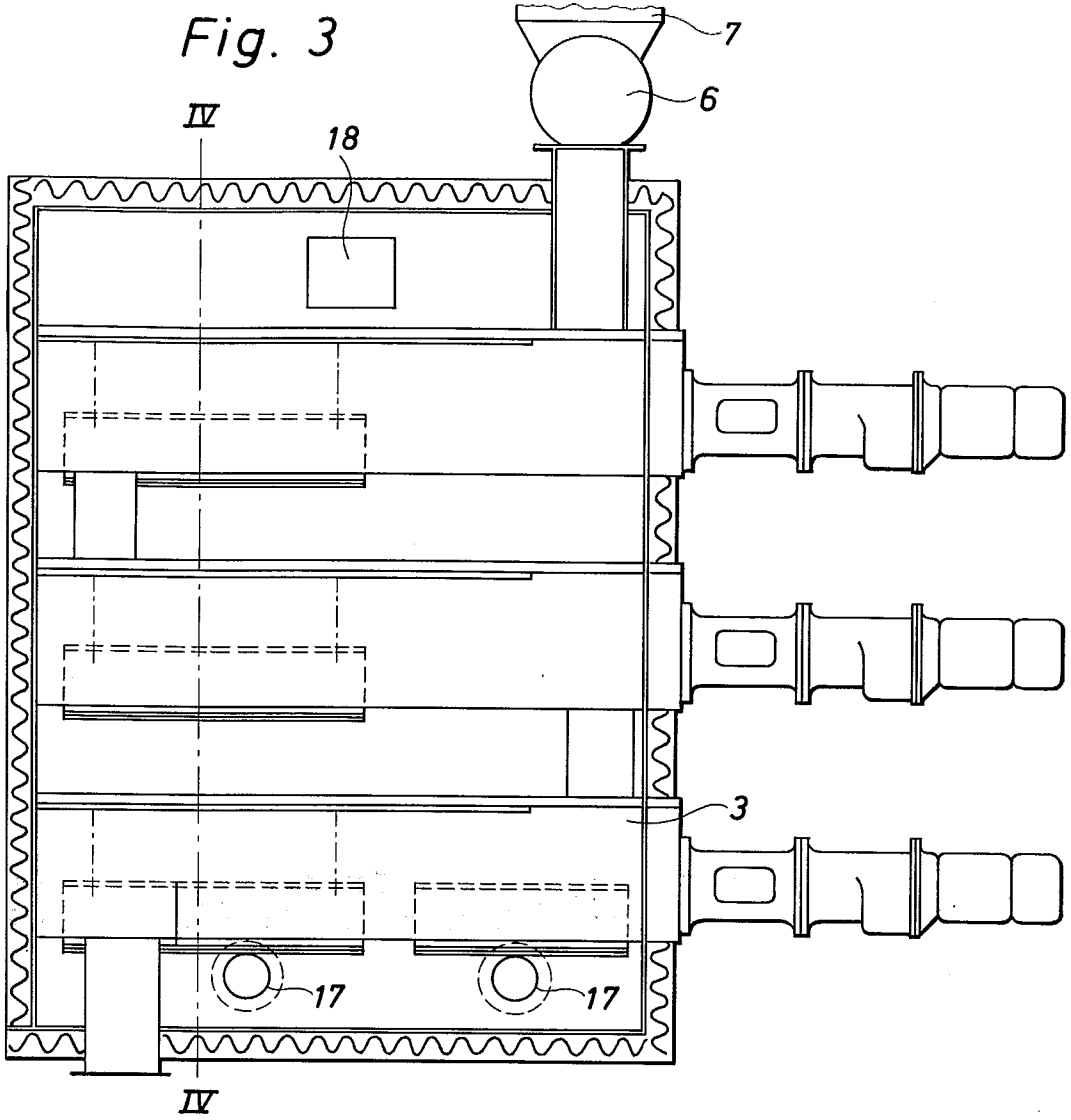
Figure 4:
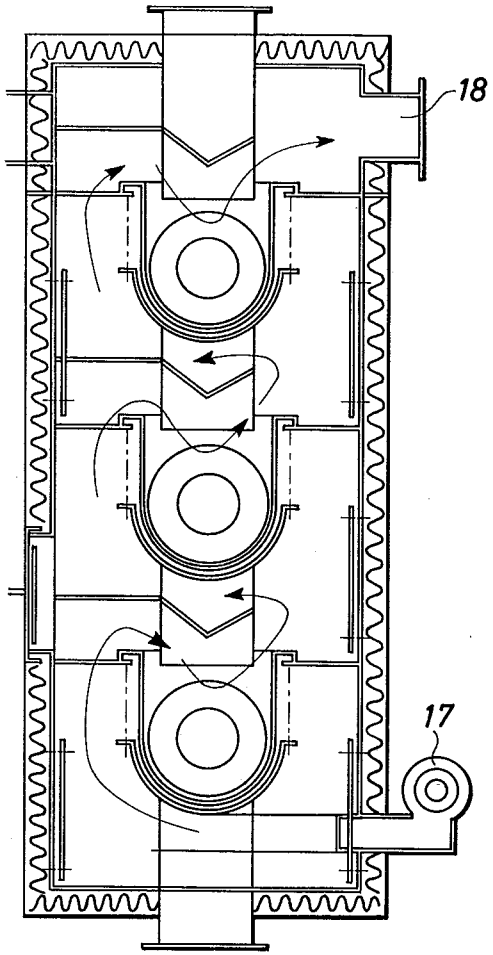

The invention will be described below with reference to the accompanying drawings, in which FIG. 1 is a longitudinal cross section through an apparatus having three sections arranged on top of each other, each section having a flue gas unit, FIG. 2 a cross section taken along the line II—II of FIG. 1, FIG. 3 a longitudinal cross section through an apparatus, the flue gas units of which are arranged below the lowermost section, FIG. 4 is a cross section taken along the line IV-IV of FIG. 3.

Figure 2:
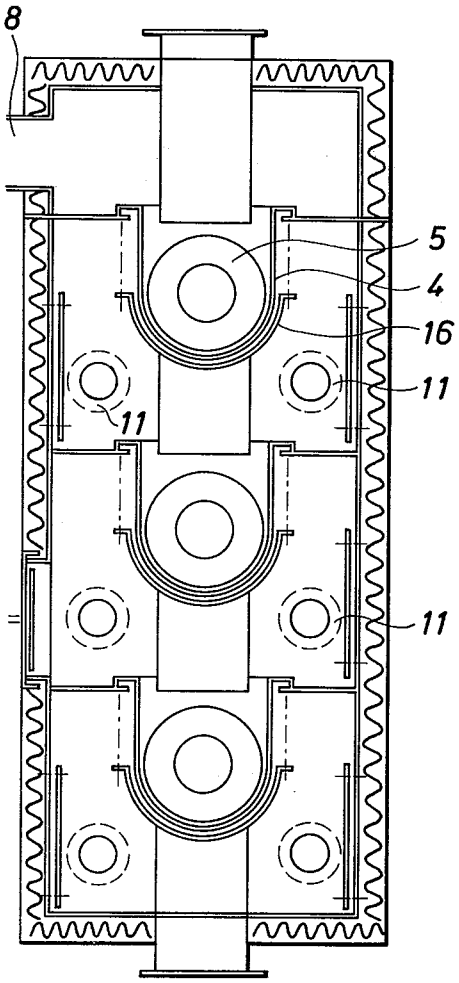

The sections 1, 2 and 3 of the apparatus shown in FIG. 1 and 2 consist each of a trough 4, in which a conveyor is arranged in form of a conveyor screw 5, conducting the material, which has been dropped through a valve 6 from a silo 7, to the left end of the conveyor. From this left end the material is conducted downwardly through a discharge channel 8 into the conveyor 2, which is conveying the material in opposite direction. Then the material runs through a channel 9 down into the conveyor 3 and the material leaves this conveyor through a channel 10. From this point the material is conducted direct to an asphalt mixer or to a conveyor conveying the material to a mixer.

In each section two oil burners 11 are arranged providing for necessary heating of the material. In the channel 8 a sensing device to a thermostat, which is not shown, is inserted, the thermostat automatically controlling the duration of the stationary periods of an intermittently driven electric motor 13 driving the screw 5.

When the aggregate has to be heated to the temperature of the asphalt being e.g. 200°C, the sensing device 14 of the thermostat will give rise to an increase in the duration of the stationary periods of the respective conveyor, if the temperature of the material in the channels goes substantially below the said 200°C, and conversely the sensing device will reduce the duration of the stationary periods, if the temperature increases essentially above 200°C.

The sensing device 12 provides for a corresponding control of the stationary periods of the conveyor screw 5, while a thermostat sensing device 15 controls the duration of the stationary periods of the intermediate conveyor screw.

As it appears, the partitions between the sections are bent inwardly and downwardly so that the flue gases from one section can only flow upwardly to the section above when said gases have passed through the threads of the conveyor screw.

16 is a burner plate protecting the trough 4 against the direct flame of the oil burner 11.

In the apparatus of FIG. 3 and 4 all oil burners 17 are arranged below the lowermost section so that the flue gases will flow upwardly through all sections and away through a chimney 18.

If it is desired to change the capactity of the apparatus, while the apparatus is in function, a capacity button has to be adjusted thus ensuring that the capacity of each conveyor is controlled proportionally, and simultaneously the valve 6 will be adjusted to the new desired capacity. At increased capacity the conveyors will move more slowly so that the material will be held longer in each section in order to reach the desired temperature, said temperature being measured in the material discharge channel as mentioned above.

I claim:

1. In an asphalt mixing apparatus, a means for heating granular aggregate material comprising, a chamber, conveyor means in the chamber for supporting granular aggregate material and moving it intermittently through the chamber, said conveyor means including a plurality of serially arranged conveyor sections, each of said conveyor sections having temperature sensing means for sensing the temperature of aggregate material therein, means for producing flue gases and directing them through the chamber for heating the granular aggregate material in the chamber, said flue gases being chemically inert to the aggregate, and control means connected to and responsive to the temperature sensing means for controlling the temperature of the aggregate by changing the duration of stationary periods between the periods of conveyor movement.

2. The apparatus of claim 1 wherein the conveyor means is a screw conveyor.

3. The apparatus of claim 1 wherein the conveyor means is a scraping conveyor.

4. The apparatus of claim 1 wherein the means for producing flue gases includes an oil burner.

5. The apparatus of claim 1 wherein said conveyor sections are vertically spaced, said means for producing flue gases being located beneath the lowermost said conveyor section whereby flue gases flow upwardly from one section to the other.

6. The apparatus of claim 5 having partition means in the chamber for directing flue gases around the conveyor means to heat aggregate material therewithin before the flue gases flow upwardly into the next higher conveyor section.

* * * * *